US009917399B2

(12) United States Patent
Gessford et al.

(10) Patent No.: US 9,917,399 B2
(45) Date of Patent: Mar. 13, 2018

(54) REDUCED STRESS ELECTRICAL CONNECTOR

(71) Applicant: TEKTRONIX, INC., Beaverton, OR (US)

(72) Inventors: Marc A. Gessford, North Plains, OR (US); Neil C. Clayton, Hillsboro, OR (US); Edward Larry Alexander, Jr., Margate, FL (US); Domenic Anthony Lopresti, Palm Beach, FL (US); David Skoog, Boca Raton, FL (US)

(73) Assignee: Tektronix, Inc., Beaverton, OR (US)

( * ) Notice: Subject to any disclaimer, the term of this patent is extended or adjusted under 35 U.S.C. 154(b) by 0 days.

(21) Appl. No.: 15/258,971

(22) Filed: Sep. 7, 2016

(65) Prior Publication Data

US 2017/0077645 A1 Mar. 16, 2017

Related U.S. Application Data

(60) Provisional application No. 62/217,210, filed on Sep. 11, 2015.

(51) Int. Cl.

| | |
|---|---|
| ***H01R 13/627*** | (2006.01) |
| ***H01R 24/28*** | (2011.01) |
| ***H01R 24/38*** | (2011.01) |
| ***H01R 9/05*** | (2006.01) |
| *H01R 103/00* | (2006.01) |

(52) U.S. Cl.

CPC ..... *H01R 13/6271* (2013.01); *H01R 9/05* (2013.01); *H01R 24/28* (2013.01); *H01R 24/38* (2013.01); *H01R 2103/00* (2013.01)

(58) Field of Classification Search

CPC .... H01R 13/6271; H01R 24/28; H01R 24/38; H01R 9/05; H01R 9/0518; H01R 9/0527

USPC ..... 439/578–595

See application file for complete search history.

(56) References Cited

U.S. PATENT DOCUMENTS

| | | | | |
|---|---|---|---|---|
| 3,184,706 | A * | 5/1965 | Atkins | H01R 9/0521 174/89 |
| 4,912,428 | A | 3/1990 | Shen | |
| 5,435,745 | A * | 7/1995 | Booth | H01R 9/0521 439/583 |

(Continued)

OTHER PUBLICATIONS

European Search Report for EP Application No. 16188187, dated Jun. 1, 2017, 10 pages.

*Primary Examiner* — Harshad C Patel

(74) *Attorney, Agent, or Firm* — Marger Johnson; Kevin D. Dothager

(57) ABSTRACT

An electrical connector including a main body, a base portion, and a tapered end. The electrical connector extends axially in a first direction and an opposite second direction. The main body is configured to connect to an electrical cable. The base portion abuts the main body at a first end of the base portion and has an outer shoulder at a second end of the base portion. The tapered end extends and tapers from the outer shoulder in the second direction. The tapered end includes a plurality of resilient fingers separated by slots. The fingers extend away from the base portion in the second direction to a distal end of the fingers. The slots extend radially through the tapered end. The slots further extend axially in the first direction from the distal end through the outer shoulder.

16 Claims, 4 Drawing Sheets

(56) References Cited

U.S. PATENT DOCUMENTS

| | | | | |
|---|---|---|---|---|
| 5,934,937 | A * | 8/1999 | McCarthy | H01R 4/5033 439/427 |
| 6,827,608 | B2 | 12/2004 | Hall et al. | |
| 8,113,878 | B2 * | 2/2012 | Clausen | H01R 24/564 439/584 |
| 2006/0194465 | A1 * | 8/2006 | Czikora | H01R 13/6315 439/248 |
| 2007/0004276 | A1 | 1/2007 | Stein | |
| 2011/0237124 | A1 * | 9/2011 | Flaherty | H01R 13/6277 439/578 |
| 2012/0270438 | A1 | 10/2012 | Natoli | |
| 2013/0137300 | A1 * | 5/2013 | Eriksen | H01R 9/0524 439/583 |

* cited by examiner

REDUCED STRESS ELECTRICAL CONNECTOR

CROSS-REFERENCES TO RELATED APPLICATIONS

This patent application claims the benefit of provisional Application No. 62/217,210 filed Sep. 11, 2015, which is incorporated in this patent application by this reference.

FIELD OF THE INVENTION

This disclosure is directed to an electrical connector for a cable, and, more particularly, to a blind-mate RF connector.

BACKGROUND

Coaxial cable, or coax, generally has an inner conductor, or core, surrounded by an inner insulating layer. The insulating layer, in turn, is surrounded by a woven, or braided, conductive shield, which is typically connected to ground. This cable also generally includes an outer insulating layer that covers the braided conductor. Because the inner conductor and the braided conductor share a longitudinal axis, they are said to be coaxial. Such coaxial cables are commonly used as transmission lines for radio frequency (RF) signals, including high speed or high fidelity signals.

To allow the cables to be electrically connected to other components, the ends of the cables are generally terminated with connectors. These cable-terminating connectors may in turn be connected to other connectors. Accordingly, there are many different conventional connectors, which vary based on size, fastening mechanism, and configuration. Examples of different connector types are G3PO, Gore100, and SMPS.

As speed and performance requirements increase for the high speed or high fidelity signals transmitted by the cables, the coaxial connectors are scaled down. These smaller physical structures present challenges with regard to manufacturability, repeatability, and design margin. For example, some conventional micro-scale connectors have flexible fingers that yield, or permanently deform, during a typical insertion and extraction cycle. This can cause intermittent connections, loss of signal or suck-outs, poor performance, and reliability deficiencies.

Embodiments of the invention address these and other issues in the prior art.

SUMMARY OF THE DISCLOSURE

Embodiments of the disclosed subject matter provide a blind-mate connector having resilient fingers that may be repeatedly inserted into and then removed from a mating connector, such as a shroud connector, generally without yielding the material of the blind-mate connector.

Accordingly, at least some embodiments of an electrical connector may include a main body, a base portion, and a tapered end. The electrical connector extends axially in a first direction and an opposite second direction. The main body is configured to connect to an electrical cable. The base portion abuts the main body at a first end of the base portion and has an outer shoulder at a second end of the base portion. The base portion also has an outer diameter smaller than an outer diameter of the main body. The tapered end extends and tapers from the outer shoulder of the base portion in the second direction. The tapered end includes a plurality of resilient fingers separated by slots. The resilient fingers extend away from the base portion in the second direction to a distal end of the resilient fingers. The slots extend radially through the tapered end. The slots further extend axially in the first direction from the distal end of the resilient fingers through the outer shoulder of the base portion.

In another aspect, at least some embodiments of an electrical connector may include a first end and a second end. The first end is configured to mate with an electrical cable. The second end is configured to mate with a shroud connector. The second end has a tapered portion, an untapered portion, and a shoulder separating the tapered portion and the untapered portion. The tapered portion includes a plurality of resilient fingers separated by slots. The resilient fingers extend longitudinally from the shoulder to a distal end of the tapered portion. The slots extend transversely through the tapered portion and longitudinally from the distal end of the resilient fingers to partially into the untapered portion.

Hence, embodiments of the electrical connector provide a durable and reliable connection between a shroud connector and a connector terminating an end of a cable.

DETAILED DESCRIPTION

As described herein, embodiments of the invention are directed to an electrical connector and a connector assembly incorporating such an electrical connector. The electrical connector provides a durable and reliable connection between a shroud connector, which may be statically mounted to an electronic device, and a cable-end connector terminating an end of a cable. The electrical connector, which has resilient fingers, may be repeatedly inserted into and removed from the shroud connector, generally without yielding the material of the electrical connector.

Figure 1:
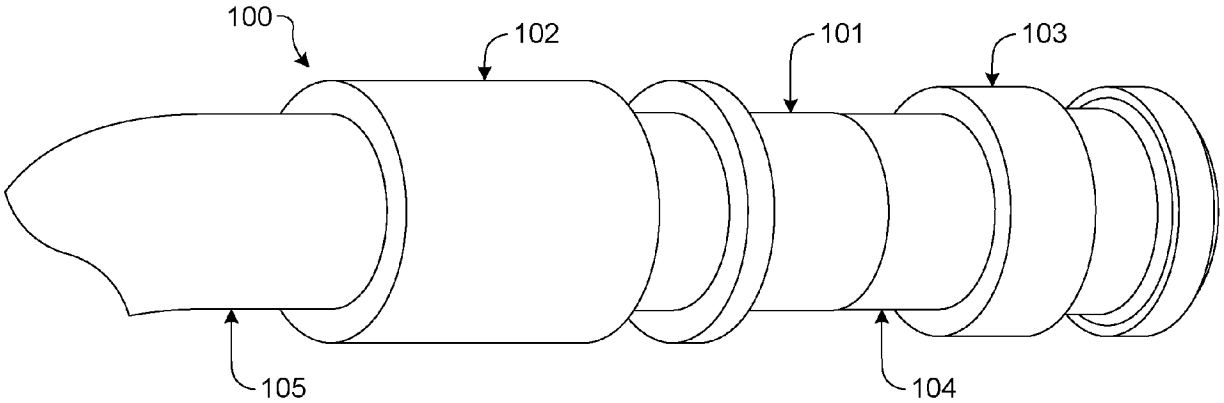
FIG. 1 is a perspective view of a connector assembly, according to embodiments of the invention, connected to a coaxial cable.

FIG. 1 is a perspective view of a connector assembly 100. Embodiments of the connector assembly 100, such as illustrated in FIG. 1, may include a blind-mate connector 101, a cable-end connector 102, a shroud connector 103, and a collar 104.

The cable-end connector 102 may be any connector configured to terminate a cable, such as a coaxial cable 105. The cable-end connector 102 is configured to mate with the blind-mate connector 101. For example, the cable-end connector 102 may be threaded to the blind-mate connector 101, or the cable-end connector 102 may slide into or around a portion of the blind-mate connector 101. Other mating configurations are also possible.

Figure 7:
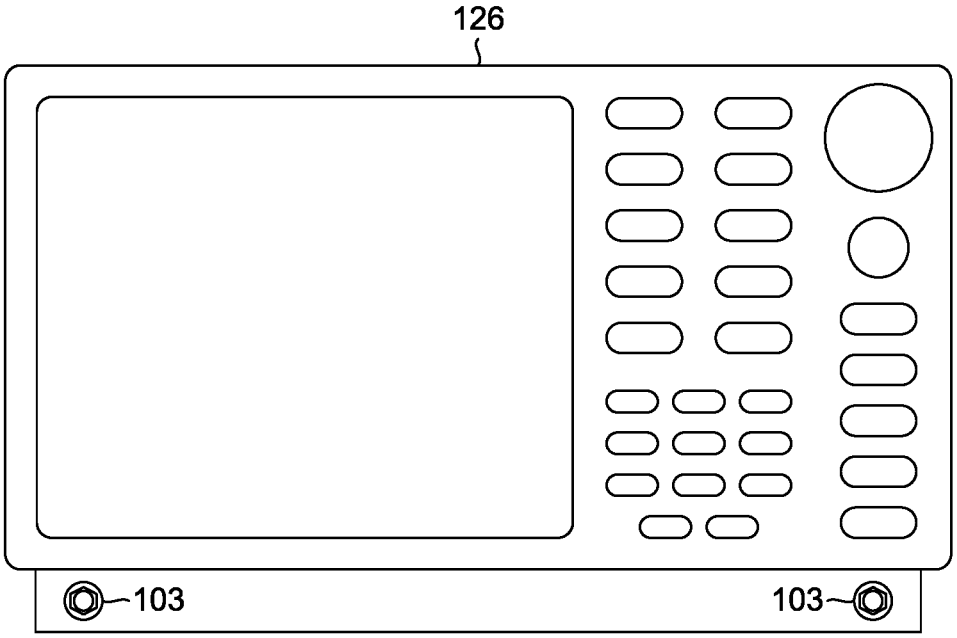
FIG. 7 is a diagram showing a shroud connector mounted to an input of a test and measurement instrument.

The shroud connector 103 is configured to mate with the blind-mate connector 101. Specifically, the shroud connector 103 is configured to repeatedly receive and release the tapered end 108 of the blind-mate connector 101, as more fully described below for FIGS. 4 and 5. Typically, the shroud connector 103 is statically mounted to another component, such as a printed circuit board, another RF connector, or an input to a test and measurement instrument, such as the test and measurement instrument 126 of FIG. 7.

Figure 3:
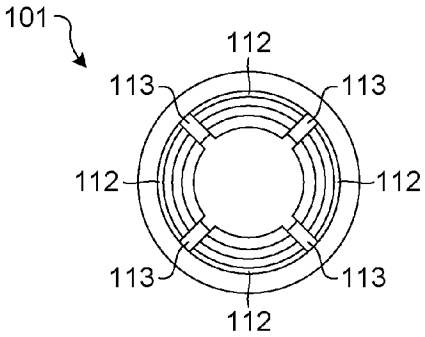
FIG. 3 is an end view of the blind-mate connector of FIG. 2.
Figure 2:
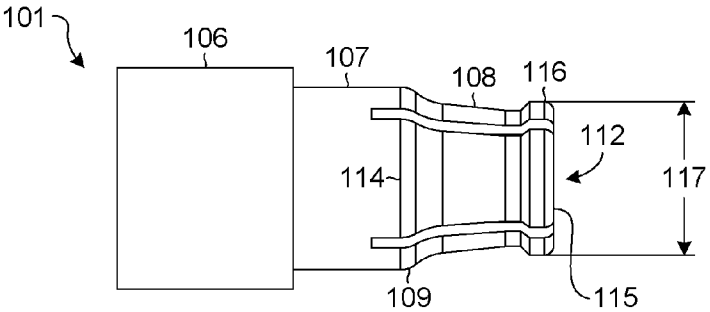
FIG. 2 is a side view of a blind-mate connector, which is part of the connector assembly of FIG. 1.

FIG. 2 is a side view of a blind-mate connector 101, which may be part of a connector assembly, such as the connector assembly 100 of FIG. 1. FIG. 3 is an end view of the blind-mate connector 101 of FIG. 2. The blind-mate connector 101, such as illustrated in FIGS. 2 and 3, has a main body 106, a base portion 107, and a tapered end 108 configured for insertion into the shroud connector 103. The main body 106 is configured to connect to an electrical cable, such as coaxial cable 105. The connection between the main body 106 and the electrical cable may be through the cable-end connector 102. The tapered end 108 extends from an outer shoulder 109 of the blind-mate connector 101. Preferably, the outer shoulder 109 corresponds to a rightmost end 110 of dielectric 111, as more fully described below for FIGS. 4 and 5. The outer shoulder 109 is generally the transition between the substantially untapered base portion 107 and the tapered end 108.

Figure 4:
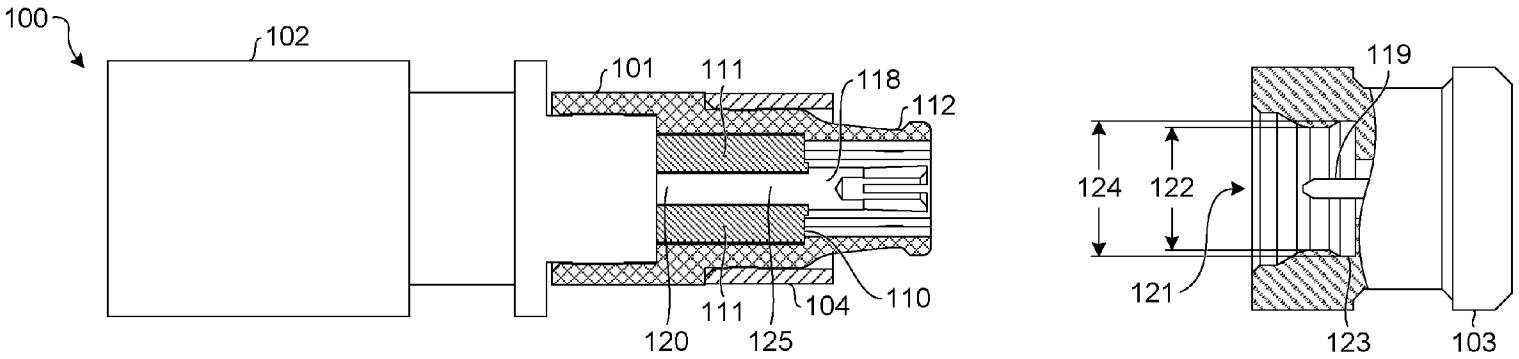
FIG. 4 is a partial, axial cross-section of the connector assembly of FIG. 1, with the shroud separated from the remainder of the connector assembly.

As illustrated in FIGS. 2 and 4, the base portion 107 abuts or is otherwise continuous with the main body 106. The base portion 107 has an outer diameter smaller than an outer diameter of the main body 106.

The tapered end 108 has a plurality of resilient fingers 112 extending from the base portion 107 of the blind-mate connector 101. Preferably, there are an even number of resilient fingers 112, such as two, four, six, or eight fingers. More preferably, there are four resilient fingers 112. When viewed from the tapered end 108, the resilient fingers 112 may be arcuate, as shown in FIG. 3, for example.

The resilient fingers 112 are separated by radially spaced slots 113. The slots 113 extend radially or transversely through the tapered end, as shown in FIG. 3, for example. Preferably, the slots 113 are evenly spaced about the tapered end 108 of the blind-mate connector 101. For example, if there are four slots 113, each slot 113 may be about ninety degrees from the adjacent slots 113. In some embodiments, the slots 113 are not evenly spaced, meaning that some pairs of adjacent slots 113 may be radially closer or farther apart than other pairs of adjacent slots 113. For example, if there are three slots 113, one of the slots may be ninety degrees from one adjacent slot and one-hundred fifty degrees from the other adjacent slot, the two adjacent slots thus being one-hundred twenty degrees from each other in this example.

Figure 5:
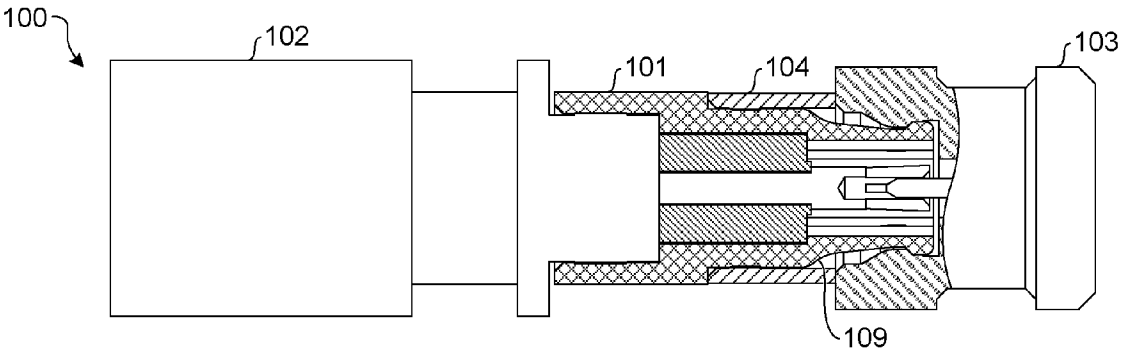
FIG. 5 is a partial, axial cross-section of the connector assembly of FIG. 1.

Preferably, each slot 113 extends in a longitudinal or axial direction through and beyond the outer shoulder 109 of the blind-mate connector 101. Hence, the slots 113 generally extend into part of the base portion 107, as shown in FIG. 2, for example. More preferably, each slot 113 also extends beyond the rightmost end 110 of the dielectric 111, as shown in FIGS. 4 and 5, thus overlapping the dielectric 111. Thus, the fingers 112 of the blind-mate connector 101 are longer than fingers in conventional connectors, which do not overlap the dielectric 111. The longer fingers 112 of the blind-mate connector 101 result in reduced stress when the resilient fingers 112 are repeatedly inserted into and then removed from the shroud connector 103 during typical use.

Each resilient finger has a base end 114 and a distal end 115. The base end 114 is connected to the base portion 107 of the blind-mate connector 101. The distal end 115 includes a fillet or protruding edge 116 that extends transversely or radially from the distal end 115 of the finger. Collectively, the protruding edges 116 of the resilient fingers 112 have an outer diameter 117. The protruding edges 116 are generally rounded or otherwise configured to facilitate repeated insertion into and removal of the tapered end 108 from the shroud connector 103.

Preferably, the fingers 112 are made from a metal or alloy having a yield strength greater than about 150 ksi (kilo pounds per square inch). Yield strength may be determined by using, as an example, a 0.2% offset yield point per ASTM E8. More preferably, the fingers 112 are made from beryllium copper. Even more preferably, the fingers 112 are made from beryllium copper having a full hard temper and a yield strength of about 185 ksi. Embodiments of the disclosed blind-mate connector 101 are designed to operate below the material's yield strength when the resilient fingers 112 are cycled, such as when the blind-mate connector 101 is repeatedly inserted into and then removed from the shroud connector 103 during typical use.

FIG. 4 is a partial cross-section of the connector assembly 100 of FIG. 1, with the shroud connector 103 separated from the remainder of the connector assembly 100. The cable-end connector 102 is not shown in cross-section, nor is the right end of the shroud connector 103. The interior of the blind-mate connector 101 includes dielectric 111 and a center conductor 125. The center conductor 125 of the blind-mate connector 101 is configured to electrically connect with the cable-end connector 102 at a left end 120 of the center conductor 125 and a center pin 119 of the shroud connector 103 at a right end 118 of the center conductor 125. Thus, a signal, such as an RF signal, may pass from the coaxial cable 105 (see FIG. 1), through the cable-end connector 102 and the blind-mate connector 101, to the shroud connector 103.

The dielectric 111 of the blind-mate connector 101 generally surrounds a longitudinal portion of the center conductor 125. For example, the dielectric 111 may surround the length of the center conductor 125 that is within the base portion 107, such as shown in FIG. 4. The dielectric 111 has a rightmost end 110 such that the dielectric 111 generally does not extend axially into the tapered end 108 of the blind-mate connector 101. The outer shoulder 109 (see FIG. 2) generally corresponds to the rightmost end 110 of dielectric 111. In other words, the outer shoulder 109 may be transversely or axially aligned with the rightmost end 110 of dielectric 111, as shown in FIG. 4, for example.

Also as shown in FIG. 4, the collar 104 circumferentially surrounds the base portion 107 of the blind-mate connector 101 (see FIG. 2), immediately adjacent to the base portion 107. An outer diameter of the collar 104 is substantially equal to the outer diameter of the main body 106. The collar 104 may be press fit onto an outer face of the base portion 107 of the blind-mate connector 101, although other techniques may also be used to fit the collar 104 to the blind-mate connector 101.

The collar 104 is configured to electrically shield a signal passing through the blind-mate connector 101. Preferably, the collar 104 is made from a conductive material, such as a metal. More preferably, the collar 104 is made from stainless steel. Even more preferably, the collar 104 is made from unplated stainless steel.

The collar 104 may abut the main body 106 and may extend axially beyond (i.e. to the right of, as illustrated) the outer shoulder 109, such as shown in FIGS. 4 and 5. Hence, when the blind-mate connector 101 is assembled to the shroud connector 103, such as shown in FIG. 5, the collar 104, along with the main body 106, may provide continuous shielding of a signal passing through the connector assembly 100.

FIG. 5 is a partial cross-section of the connector assembly 100 of FIG. 1, with the shroud connector 103 mated to the connector assembly 100. The cable-end connector 102 is not shown in cross-section, nor is the right end of the shroud connector 103. To connect the blind-mate connector 101 to the shroud connector 103, the tapered end 108 of the blind-mate connector 101 may be inserted into a correspondingly tapered channel 121 of the shroud connector 103. The tapered channel 121 narrows to an inner diameter 122 that is less than the outer diameter 117 (FIG. 2) of the collective protruding edges 116 of the resilient fingers 112. Thus, the fingers 112 are radially compressed by the tapered channel 121 as the blind-mate connector 101 is inserted into the shroud connector 103. As the fingers 112 are radially compressed, the fingers 112 in turn may compress the dielectric 111 within the blind-mate connector 101. A second end of the tapered channel 121 includes a radial groove 123 that is configured to accept the collective protruding edges 116 of the resilient fingers 112. An inner diameter 124 of the radial groove 123 is greater than the inner diameter 122 of the tapered channel 121. Thus, due to the resiliency of the fingers 112, the fingers 112 radially expand into the radial groove 123, securing the blind-mate connector 101 to the shroud connector 103. To separate the blind-mate connector 101 from the shroud connector 103, axial force may be applied to blind-mate connector 101 or to the shroud connector 103, reversing the process just described.

Figure 6:
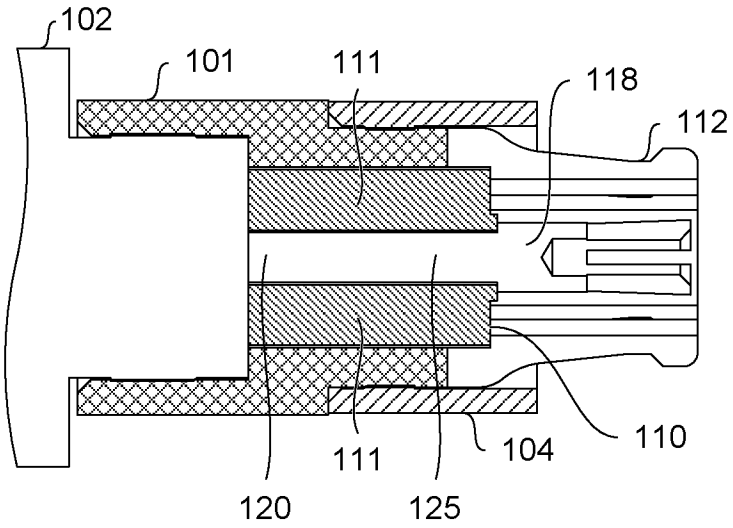
FIG. 6 is a cross-section of the blind-mate connector shown in FIG. 1, with the cross section taken through two of the slots.

FIG. 6 is a cross-section of the blind-mate connector 101, with the cross-section taken through two of the slots 113.

Note that directions such as "right," "left," and "rightmost" are used for convenience and in reference to the views provided in figures. But the connector assembly 100 may have a number of orientations in actual use. Thus, a feature that is vertical, horizontal, to the right, or to the left in the figures may not have that same orientation or direction in actual use. Moreover, axially means along or parallel to the longitudinal axis, while transverse and radial each mean perpendicular to the longitudinal axis.

The previously described versions of the disclosed subject matter have many advantages that were either described or would be apparent to a person of ordinary skill. Even so, all of these advantages or features are not required in all versions of the disclosed apparatus, systems, or methods.

Additionally, this written description makes reference to particular features. It is to be understood that the disclosure in this specification includes all possible combinations of those particular features. For example, where a particular feature is disclosed in the context of a particular aspect or embodiment, that feature can also be used, to the extent possible, in the context of other aspects and embodiments.

Furthermore, the term "comprises" and its grammatical equivalents are used in this application to mean that other components, features, steps, processes, operations, etc. are optionally present. For example, an article "comprising" or "which comprises" components A, B, and C can contain only components A, B, and C, or it can contain components A, B, and C along with one or more other components.

Although specific embodiments of the invention have been illustrated and described for purposes of illustration, it will be understood that various modifications may be made without departing from the spirit and scope of the invention. Accordingly, the invention should not be limited except as by the appended claims.

The invention claimed is:

1. An electrical connector extending axially in a first direction and an opposite second direction, the electrical connector comprising:
   - a main body configured to connect to an electrical cable;
   - a center conductor configured to carry an electrical signal through the electrical connector;
   - a base portion abutting the main body at a first end of the base portion and having an outer shoulder at a second end of the base portion, the base portion having an outer diameter smaller than an outer diameter of the main body and a dielectric axially surrounding a portion of the center conductor; and
   - a tapered end extending and tapering from the outer shoulder of the base portion in the second direction, the tapered end comprising a plurality of resilient fingers separated by slots and extending away from the base portion in the second direction to a distal end of the resilient fingers, the slots extending radially through the tapered end, and the slots further extending axially in the first direction from the distal end of the resilient fingers through the outer shoulder of the base portion, in which the slots extend in the first direction beyond the extent of the dielectric in the second direction, such that the slots longitudinally overlap the dielectric.

2. The electrical connector of claim 1, in which the main body is configured to connect to a cable-end connector of the electrical cable.

3. The electrical connector of claim 1, in which the outer shoulder corresponds axially to an extent of the dielectric in the second direction within the electrical connector.

4. The electrical connector of claim 1, in which the slots are evenly spaced radially about the tapered end.

5. The electrical connector of claim 4, in which the slots are four slots radially spaced by about ninety degrees.

6. The electrical connector of claim 1, in which the resilient fingers comprise a metal having a yield strength greater than 150 ksi.

7. The electrical connector of claim 1, in which the fingers comprise beryllium copper having a full hard temper and a yield strength of about 185 ksi.

8. The electrical connector of claim 1, further comprising a collar circumferentially surrounding the base portion, an outer diameter of the collar being substantially equal to the outer diameter of the main body.

9. The electrical connector of claim 8, in which the collar abuts the main body at a first end of the collar and a second end of the collar extends axially beyond the outer shoulder in the second direction.

10. The electrical connector of claim 8, in which the collar is conductive and is configured to shield an electrical signal passing through the electrical connector.

11. The electrical connector of claim 1, in which the tapered end of the electrical connector is configured to repeatedly accept and release a shroud connector.

12. An electrical connector comprising:
   - a first end configured to mate with an electrical cable;
   - a center conductor configured to carry an electrical signal through the electrical connector;
   - a second end configured to mate with a shroud connector, the second end having a tapered portion, an untapered portion, and a shoulder separating the tapered portion and the untapered portion, the tapered portion comprising a dielectric axially surrounding a portion of the center conductor and a plurality of resilient fingers separated by slots and extending longitudinally from the shoulder to a distal end of the tapered portion, the slots extending transversely through the tapered portion and longitudinally from the distal end of the resilient fingers partially into the untapered portion, in which the slots longitudinally overlap the dielectric.

13. The electrical connector of claim 12, in which the shoulder corresponds transversely to a longitudinal extent of the dielectric within the electrical connector.

14. The electrical connector of claim 12, further comprising a collar adjacently surrounding the untapered portion, in which the collar extends longitudinally beyond the shoulder to also surround part of the tapered portion.

15. The electrical connector of claim 14, in which the collar is conductive and is configured to shield an electrical signal passing through the electrical connector.

16. The electrical connector of claim 12, in which the resilient fingers have a yield strength greater than 150 ksi.

* * * * *